US008431489B2

(12) United States Patent
Kulp et al.

(10) Patent No.: US 8,431,489 B2
(45) Date of Patent: Apr. 30, 2013

(54) CHEMICAL MECHANICAL POLISHING PAD HAVING A LOW DEFECT WINDOW

(75) Inventors: Mary Jo Kulp, Newark, DE (US); Shannon H Williams, Newtown Square, PA (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 13/563,137

(22) Filed: Jul. 31, 2012

(65) Prior Publication Data

US 2012/0295442 A1 Nov. 22, 2012

Related U.S. Application Data

(62) Division of application No. 12/482,182, filed on Jun. 10, 2009, now Pat. No. 8,257,544.

(51) Int. Cl.
*H01L 21/302* (2006.01)

(52) U.S. Cl.
USPC ..... 438/692; 451/285; 451/41; 451/527; 451/6; 451/533

(58) Field of Classification Search ..... 156/253, 156/345.12; 264/235, 259, 328.16, 45.4; 428/156, 188, 313.5; 438/692; 451/285, 451/41, 527, 529, 533, 6
See application file for complete search history.

(56) References Cited

U.S. PATENT DOCUMENTS

| | | | |
|---|---|---|---|
| 5,605,760 | A | 2/1997 | Roberts |
| 6,387,312 | B1 | 5/2002 | Roberts et al. |
| 6,685,537 | B1 | 2/2004 | Fruitman et al. |
| 6,860,793 | B2 | 3/2005 | Budinger et al. |
| 6,984,163 | B2 | 1/2006 | Roberts |
| 7,169,030 | B1 | 1/2007 | Kulp |
| 2010/0035529 | A1 | 2/2010 | Kulp et al. |

*Primary Examiner* — Duy Deo
*Assistant Examiner* — Erin Bergner
(74) *Attorney, Agent, or Firm* — Thomas S. Deibert

(57) ABSTRACT

A chemical mechanical polishing pad having a polishing layer with an integral window and a polishing surface adapted for polishing a substrate selected from a magnetic substrate, an optical substrate and a semiconductor substrate, wherein the formulation of the integral window provides improved defectivity performance during polishing. Also provided is a method of polishing a substrate using the chemical mechanical polishing pad.

8 Claims, No Drawings

CHEMICAL MECHANICAL POLISHING PAD HAVING A LOW DEFECT WINDOW

The present invention relates generally to the field of chemical mechanical polishing. In particular, the present invention is directed to a chemical mechanical polishing pad having a low defect integral window. The present invention is also directed to a method of chemical mechanical polishing a substrate using a chemical mechanical polishing pad having a low defect integral window.

In the fabrication of integrated circuits and other electronic devices, multiple layers of conducting, semiconducting and dielectric materials are deposited on or removed from a surface of a semiconductor wafer. Thin layers of conducting, semiconducting, and dielectric materials may be deposited by a number of deposition techniques. Common deposition techniques in modern processing include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes nonplanar. Because subsequent semiconductor processing (e.g., metallization) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

Chemical mechanical planarization, or chemical mechanical polishing (CMP), is a common technique used to planarize substrates, such as semiconductor wafers. In conventional CMP, a wafer is mounted on a carrier assembly and positioned in contact with a polishing pad in a CMP apparatus. The carrier assembly provides a controllable pressure to the wafer, pressing it against the polishing pad. The pad is moved (e.g., rotated) relative to the wafer by an external driving force. Simultaneously therewith, a chemical composition ("slurry") or other polishing solution is provided between the wafer and the polishing pad. Thus, the wafer surface is polished and made planar by the chemical and mechanical action of the pad surface and slurry.

One problem associated with chemical mechanical polishing is determining when the substrate has been polished to the desired extent. In situ methods for determining polishing endpoints have been developed. One such method utilizes laser interferomety wherein light generated by a laser is used to measure substrate dimensions. As a consequence, chemical mechanical polishing pads have been developed with features that facilitate the determination of substrate dimensional characteristics by optical methods. For example, U.S. Pat. No. 5,605,760 discloses a polishing pad wherein at least a portion of the pad is transparent to laser light over a range of wavelengths. In one embodiment, the polishing pad includes a transparent window piece in an otherwise opaque pad. The window piece may be a rod or plug of transparent polymer material in a molded polishing pad. The rod or plug may be insert molded within the polishing pad (i.e., integral window), or may be installed into a cutout in the polishing pad after the molding operation (i.e., plug-in-place window).

Conventional chemical mechanical polishing pads comprising plug-in-place windows are prone to leaking of polishing medium at the interface between the plug-in-place window and the remainder of the chemical mechanical polishing pad. This leakage of polishing medium can permeate into the polishing layer, intervening layer or subpad layer causing regional differences in, for example, the compressibility of the polishing layer resulting in increased polishing defects.

The leakage of polishing medium can also penetrate through the polishing pad and cause damage to the polishing apparatus.

Conventional chemical mechanical polishing pads comprising integral windows are prone to increased polishing defects relative to plug-in-place windows due to the window bulging outward from the polishing pad over time with use of the pad causing polishing defects (e.g., scratching of the substrate being polished).

Hence, what is needed is an improved chemical mechanical polishing pad having a window which alleviates the leakage issues conventionally associated with plug-in-place windows and the polishing defectivity issues associated with conventional integral windows.

In one aspect of the present invention, there is provided a chemical mechanical polishing pad comprising: a polishing layer having a polishing surface and an integral window; wherein the integral window is integrated in the polishing layer; wherein the integral window is a polyurethane reaction product of a curative agent and an isocyanate-terminated prepolymer polyol; wherein the curative agent contains curative amine moieties that react with the unreacted NCO moieties contained in the isocyanate-terminated prepolymer polyol to form the integral window; wherein the curative agent and the isocyanate-terminated prepolymer polyol are provided at an amine moiety to unreacted NCO moiety stoichiometric ratio of 100 to 125%; wherein the integral window has a porosity of <0.1 wt % by volume; wherein the integral window exhibits an average compression set of 5 to 25%; wherein the polishing surface is adapted for polishing a substrate selected from a magnetic substrate, an optical substrate and a semiconductor substrate.

In another aspect of the present invention, there is provided a method for chemical mechanical polishing of a substrate selected from a magnetic substrate, an optical substrate and a semiconductor substrate; comprising: providing a chemical mechanical polishing apparatus having a platen; providing at least one substrate selected from a magnetic substrate, an optical substrate and a semiconductor substrate; selecting a chemical mechanical polishing pad having a polishing layer, wherein the polishing layer comprises an integral window formed therein, wherein the integral window exhibits a compression set of 5 to 25%; installing onto the platen the chemical mechanical polishing pad; and, polishing the at least one substrate with a polishing surface of the polishing layer.

In another aspect of the present invention, there is provided a method for chemical mechanical polishing of a substrate selected from a magnetic substrate, an optical substrate and a semiconductor substrate; comprising: providing a chemical mechanical polishing apparatus having a platen; providing at least one substrate selected from a magnetic substrate, an optical substrate and a semiconductor substrate; selecting a chemical mechanical polishing pad according to claim 1; installing onto the platen the chemical mechanical polishing pad; and, polishing the at least one substrate with a polishing surface of the polishing layer.

DETAILED DESCRIPTION

The term "polishing medium" as used herein and in the appended claims encompasses particle-containing polishing solutions and non-particle-containing polishing solutions, such as abrasive-free and reactive-liquid polishing solutions.

The term "poly(urethane)" as used herein and in the appended claims encompasses (a) polyurethanes formed from the reaction of (i) isocyanates and (ii) polyols (including diols); and, (b) poly(urethane) formed from the reaction of (i)

isocyanates with (ii) polyols (including diols) and (iii) water, amines (including diamines and polyamines) or a combination of water and amines (including diamines and polyamines).

The chemical mechanical polishing pad of the present invention comprises a polishing layer having a polishing surface and an integral window; wherein the integral window is integrated in the polishing layer; wherein the integral window is a polyurethane reaction product of a curative agent and an isocyanate-terminated prepolymer polyol; wherein the curative agent contains curative amine moieties that react with the unreacted NCO moieties contained in the isocyanate-terminated prepolymer polyol to form the integral window; wherein the curative agent and the isocyanate-terminated prepolymer polyol are provided at an amine moiety to unreacted NCO moiety stoichiometric ratio of 100 to 125%; wherein the integral window has a porosity of <10.0 vol %; preferably <0.1 vol %, more preferably 0.000001 to <0.1 vol %, still more preferably 0.000001 to <0.9 vol %, most preferably 0.000001 to 0.05 vol %; wherein the integral window exhibits an average compression set of 5 to 25%, preferably 5 to 20%, more preferably 5 to 15%, still more preferably 5 to 10%, most preferably 5 to 8%; wherein the polishing surface is adapted for polishing a substrate selected from a magnetic substrate, an optical substrate and a semiconductor substrate.

Preferably, the curative and isocyanate-terminated prepolymer polyol are provided in proper proportions to give an $NH_2$ to unreacted NCO stoichimetric ratio of 100 to 125%, preferably 100 to 115%, more preferably 100 to 110%. This stoichiometry may be achieved either directly, by providing the stoichiometric levels of the raw materials, or indirectly by reacting some of the NCO with water either purposely or by exposure to adventitious moisture.

Isocyanate terminated prepolymer polyols include, for example, the reaction product of a polyol and a polyfunctional aromatic isocyanate. Suitable polyols include, for example, polyether polyols; polycarbonate polyols; polyester polyols; polycaprolactone polyols; ethylene glycol; 1,2-propylene glycol; 1,3-propylene glycol; 1,2-butanediol; 1,3-butanediol; 2-methyl-1,3-propanediol; 1,4-butanediol; neopentyl glycol; 1,5-pentanediol; 3-methyl-1,5-pentanediol; 1,6-hexanediol; diethylene glycol; dipropylene glycol; tripropylene glycol and mixtures thereof. Preferred polyols include polytetramethylene ether glycol [PTMEG]; polypropylene ether glycol [PPG]; ester-based polyols (e.g., ethylene or butylene adipates); copolymers thereof and mixtures thereof. Suitable polyfunctional aromatic isocyanates include 2,4-toluene diisocyanate; 2,6-toluene diisocyanate; 4,4'-diphenylmethane diisocyanate; naphthalene-1,5-diisocyanate; tolidine diisocyanate; para-phenylene diisocyanate; xylylene diisocyanate and mixtures thereof. Preferably, the polyfunctional aromatic isocyanate contains less than 20 weight percent, more preferably less than 15 weight percent, most preferably less than 12 weight percent aliphatic isocyanates, such as 4,4'-dicyclohexylmethane diisocyanate; isophorone diisocyanate and cyclohexanediisocyanate. Preferably, the isocyanate-terminated prepolymer polyol contains 8.75 to 9.40 wt %, preferably 8.90 to 9.30 wt %, more preferably 9.00 to 9.25 wt %, unreacted NCO moieties. Preferably, the isocyanate-terminated prepolymer polyol comprises an isocyanate-terminated polytetramethylene ether glycol. More preferably, the isocyanate-terminated prepolymer polyol comprises an isocyanate-terminated polytetramethylene ether glycol; wherein the isocyanate-terminated prepolymer polytetramethylene ether glycol contains 8.90 to 9.30 wt % unreacted NCO moieties. Most preferably, the isocyanate-terminated prepolymer polyol comprises an isocyanate-terminated polytetramethylene ether glycol; wherein the isocyanate-terminated prepolymer polytetramethylene ether glycol contains 9.00 to 9.25 wt % unreacted NCO moieties.

Curative agent includes, for example, 4,4'-methylene-bis-o-chloroaniline [MBCA], 4,4'-methylene-bis-(3-chloro-2,6-diethylaniline) [MCDEA]; dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4-toluenediamine; 3-tert-butyl-2,6-toluenediamine; 5-tert-amyl-2,4-toluenediamine; 3-tert-amyl-2,6-toluenediamine; chlorotoluenediamine and mixtures thereof. Preferably, the curative agent is MBCA.

When preparing the integral window, the raw materials and the stoichiometry are preferably chosen so that the resulting integral window material exhibits an average compression set of 5 to 25%, more preferably 5 to 20%, still more preferably 5 to 15%, yet more preferably 5 to 10%, yet still more preferably 5 to <10%, most preferably 5 to 8%, calculated according to ASTM D395-03 Method A at 70° C.

The integral window preferably exhibits an optical transmission for light at a wavelength of 670 nm in a range selected from 20 to 70%, 20 to 50% and 30 to 50%.

The chemical mechanical polishing pad of the present invention optionally further comprises a base layer interfaced with the polishing layer. The polishing layer can optionally be attached to the base layer using an adhesive. The adhesive can be selected from pressure sensitive adhesives, hot melt adhesives, contact adhesives and combinations thereof. In some embodiments, the adhesive is a hot melt adhesive. In some embodiments, the adhesive is a contact adhesive. In some embodiments, the adhesive is a pressure sensitive adhesive.

The chemical mechanical polishing pad of the present invention optionally further comprises a base layer and at least one additional layer interfaced with and interposed between the polishing layer and the base layer. The various layers can optionally be attached together using an adhesive. The adhesive can be selected from pressure sensitive adhesives, hot melt adhesives, contact adhesives and combinations thereof. In some embodiments, the adhesive is a hot melt adhesive. In some embodiments, the adhesive is a contact adhesive. In some embodiments, the adhesive is a pressure sensitive adhesive.

The chemical mechanical polishing pad of the present invention is preferably adapted to be interfaced with a platen of a polishing machine. The chemical mechanical polishing pad of the present invention is optionally adapted to be affixed to the platen using at least one of a pressure sensitive adhesive and vacuum.

The polishing surface of the polishing layer of the chemical mechanical polishing pad of the present invention optionally exhibits at least one of macrotexture and microtexture to facilitate polishing the substrate. Preferably, the polishing surface exhibits macrotexture, wherein the macrotexture is designed to alleviate at least one of hydroplaning; to influence polishing medium flow; to modify the stiffness of the polishing layer; to reduce edge effects; and, to facilitate the transfer of polishing debris away from the area between the polishing surface and the substrate.

The polishing surface of the polishing layer of the chemical mechanical polishing pad of the present invention optionally exhibits macrotexture selected from at least one of perforations and grooves. Optionally, the perforations can extend from the polishing surface part way or all of the way through the thickness of the polishing layer. Optionally, the grooves are arranged on the polishing surface such that upon rotation of the pad during polishing, at least one groove sweeps over the substrate. Optionally, the grooves are selected from curved grooves, linear grooves and combinations thereof. The grooves optionally exhibit a depth of ≧10 mils; preferably 10 to 150 mils. Optionally, the grooves form a groove pattern that comprises at least two grooves having a combination of a depth selected from ≧10 mils, ≧15 mils and 15 to 150 mils; a width selected from ≧10 mils and 10 to 100 mils; and a pitch selected from ≧30 mils, ≧50 mils, 50 to 200 mils, 70 to 200 mils, and 90 to 200 mils.

The method of the present invention for chemical mechanical polishing of a substrate selected from a magnetic substrate, an optical substrate and a semiconductor substrate; comprises: providing a chemical mechanical polishing apparatus having a platen; providing at least one substrate selected from a magnetic substrate, an optical substrate and a semiconductor substrate; selecting a chemical mechanical polishing pad having a polishing layer, wherein the polishing layer comprises an integral window formed therein, wherein the integral window exhibits a compression set of 5 to 25%, preferably 5 to 20%, more preferably 5 to 15%, still more preferably 5 to 10%, yet still more preferably 5 to 8%; installing onto the platen the chemical mechanical polishing pad; and, polishing the at least one substrate with a polishing surface of the polishing layer. Preferably, the integral window in the chemical mechanical polishing pad of the present invention bulges outward ≦50 μm, more preferably 0 to 50 μm, most preferably 0 to 40 μm from the polishing layer at the polishing surface after five hours of substrate polishing at a polishing temperature of 40° C.

Some embodiments of the present invention will now be described in detail in the following Examples.

EXAMPLES

Window Blocks:

Window blocks were prepared for integration into chemical mechanical polishing layers as integral windows as follows. Various amounts of a curative agent (i.e., MBCA) and an isocyanate-terminated prepolymer polyol (i.e., L325 available from Chemtura) as noted in Table 1 were combined and introduced into a mold. The contents of the mold were then cured in an oven for eighteen (18) hours. The set point temperature for the oven was set at 93° C. for the first twenty (20) minutes; 104° C. for the following fifteen (15) hours and forty (40) minutes; and then dropped 21° C. for the final two (2) hours. The window blocks were then cut into plugs to facilitate incorporation into polishing pad cakes by conventional means.

TABLE 1

| Ex. # | MBCA (wt %) | L325 (wt %) | Stoichiometric ratio ($NH_2$ to NCO) |
|---|---|---|---|
| Window comparative 1 | 18.4 | 81.6 | 78 |
| Window Comparative 2 | 21.5 | 78.5 | 95 |
| Window 3 | 23.2 | 76.8 | 105 |

Compression Set Testing:

Samples of the window block materials prepared as described above, were tested according to the procedure set forth in ASTM Method D395-03 Method A to determine the average compression set. The results of these experiments are provided in Table 2.

TABLE 2

| Ex. # | Measured Compression set (in %) |
|---|---|
| Window Comparative 1-1 | 1.9 |
| Window Comparative 1-2 | 2.0 |
| Window Comparative 1-3 | 2.3 |
| Window Comparative 2-1 | 4.6 |
| Window Comparative 2-2 | 4.3 |
| Window 3-1 | 6.1 |
| Window 3-2 | 5.8 |
| Window 3-3 | 7.4 |

Polishing Experiments

Polishing Pads:

Identical polishing layer formulations were used to prepare (a) a control polishing pad having a conventional integral window composition according to Window Comparative 2 described above in Table 1 having an $NH_2$ to NCO stoichimetric ratio of 95 and (b) a polishing pad having an inventive integral window composition according to Ex. 3 described above in Table 1 having an $NH_2$ to NCO stoichimetric ratio of 105. Both the control polishing pad with a conventional window formulation and the polishing pad with the inventive window formulation were 50 mils thick and had 15 mil deep, circular grooves. Both polishing layer formulations were laminated onto a Suba IV™ subpad material.

Polishing Conditions:

Copper blanket wafers were polished using an Applied Materials Mirra 200 mm polisher and polishing pads as noted above with a polishing down force of 20.7 kPa; a chemical mechanical polishing composition (EPL2361 available from Epoch Material Co., Ltd) and a flow rate of 200 ml/min; a table rotation speed of 93 rpm; a carrier rotation speed of 87 rpm; an AD3CG 181060 conditioner with a full in situ conditioning with a conditioning down force of 48.3 kPa and break in conditioning of 20 minutes, with a break in down force of 62.1 kPa followed by 10 minutes, with a break in down force of 48.3 kPa. The scratch count on the copper blanket wafers was determined after 0 hours, 2.5 hours, 5 hours, 7.5 hours and 10 hours of polishing using a KLA Tencor SP-1 unpatterned surface inspection tool. The results of these scratch count inspections are provided in Table 3.

| | Scratch Count after polishing | | | | |
|---|---|---|---|---|---|
| Example | 0 hrs | 2.5 hrs | 5 hrs | 7.5 hrs | 10 hrs |
| Polishing Control-1 | 44 | 84 | 349 | 175 | 416 |
| Polishing Control-2 | 26 | 31 | 228 | 353 | 546 |
| P1 | 183 | 143 | 60 | 58 | 109 |
| P2 | 158 | 166 | 78 | 61 | 149 |

Also, following ten (10) hours of continuous wafer polishing under the noted polishing conditions, the integral window profiles were measured at the polishing surface to determine the extent of any bulging outward of the window from the polishing surface. The Window Comparative 2 integral window material exhibited an average bulge of greater than 100

μm while the Ex. 3 integral window material exhibited an average bulge of less than 40 μm.

We claim:

1. A method for chemical mechanical polishing of a substrate selected from a magnetic substrate, an optical substrate and a semiconductor substrate; comprising:

providing a chemical mechanical polishing apparatus having a platen;

providing at least one substrate selected from a magnetic substrate, an optical substrate and a semiconductor substrate;

selecting a chemical mechanical polishing pad having a polishing layer having a polishing surface and an integral window; wherein the integral window is a polyurethane reaction product of a curative agent and an isocyanate-terminated prepolymer polyol; wherein the curative agent is selected from the group consisting of 4,4'-methylene-bis-o-chloroaniline; 4,4'-methylene-bis-(3-chloro-2,6-diethylaniline); dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4-toluenediamine; 3-tert-butyl-2,6-toluenediamine; 5-tert-amyl-2,4-toluenediamine; 3-tert-amyl-2,6-toluenediamine; chlorotoluenediamine and mixtures thereof; wherein the isocyanate-terminated prepolymer polyol is a reaction product of a polyol and a polyfunctional aromatic isocyanate; wherein the polyol is selected from the group consisting of polytetramethylene ether glycol, polypropylene ether glycol, an ester-based polyol, a copolymer thereof and a mixture thereof; wherein the polyfunctional aromatic isocyanate is selected from the group consisting of 2,4-toluene diisocyanate; 2,6-toluene diisocyanate; 4,4'-diphenylmethane diisocyanate; naphthalene-1,5-diisocyanate; toluidine diisocyanate; paraphenylene diisocyanate; xylylene diisocyanate; and, mixtures thereof; wherein the curative agent contains curative amine moieties that react with the unreacted NCO moieties contained in the isocyanate-terminated prepolymer polyol to form the integral window; wherein the curative agent and the isocyanate-terminated prepolymer polyol are provided at an amine moiety to unreacted NCO moiety stoichiometric ratio of 100 to 125%; wherein the integral window has a porosity of <0.1 vol %; wherein the integral window exhibits an average compression set of 5 to 25%; and, wherein the polishing surface is adapted for polishing a substrate selected from a magnetic substrate, an optical substrate and a semiconductor substrate;

installing onto the platen the chemical mechanical polishing pad; and, polishing the at least one substrate with the polishing surface of the polishing layer.

2. The method of claim 1, wherein the integral window bulges outward ≦50 μm from the polishing layer at the polishing surface after five hours of substrate polishing.

3. The method of claim 1, wherein the substrate is a semiconductor substrate.

4. The method of claim 1, wherein the integral window is selected to have an oval cross section in a plane parallel to the polishing surface.

5. The method of claim 1, wherein the isocyanate-terminated prepolymer polyol comprises an isocyanate-terminated polytetramethylene ether glycol.

6. The method of claim 1, wherein the isocyanate-terminated prepolymer polyol contains 8.75 to 9.40 wt % unreacted NCO moieties.

7. The method of claim 6, wherein the isocyanate-terminated polytetramethylene ether glycol contains 9.00 to 9.25 wt % unreacted NCO moieties.

8. The method of claim 1, wherein the integral window exhibits an optical transmission of 20 to 50% at 670 nm.

* * * * *